US010258128B2

(12) United States Patent
Bianconi

(10) Patent No.: US 10,258,128 B2
(45) Date of Patent: Apr. 16, 2019

(54) CONTAINER, SUCH AS A BAG OR A LEATHER ARTICLE, COMPRISING A CLASP

(71) Applicant: LORO PIANA S.P.A., Quarona (IT)

(72) Inventor: Ludovica Bianconi, Borgosesia (IT)

(73) Assignee: LORO PIANA S.P.A., Quarona (VC) (IT)

( * ) Notice: Subject to any disclaimer, the term of this patent is extended or adjusted under 35 U.S.C. 154(b) by 161 days.

(21) Appl. No.: 15/523,311

(22) PCT Filed: Oct. 27, 2015

(86) PCT No.: PCT/IB2015/058276
§ 371 (c)(1),
(2) Date: Apr. 28, 2017

(87) PCT Pub. No.: WO2016/067198
PCT Pub. Date: May 6, 2016

(65) Prior Publication Data

US 2017/0318931 A1 Nov. 9, 2017

(30) Foreign Application Priority Data

Oct. 29, 2014 (IT) ..... TO2014A0880

(51) Int. Cl.
*A45C 3/06* (2006.01)
*A45C 13/10* (2006.01)

(52) U.S. Cl.
CPC ..... *A45C 13/10* (2013.01); *A45C 3/06* (2013.01); *Y10T 24/15* (2015.01); *Y10T 24/44026* (2015.01)

(58) Field of Classification Search
CPC ... Y10T 24/44026; Y10T 24/15; A45C 33/06; A45C 13/10
USPC ..... 150/118, 100
See application file for complete search history.

(56) References Cited

U.S. PATENT DOCUMENTS 1,499,960 A * 7/1924 Almedia ..... B65D 77/185 24/30.5 R
1,588,695 A * 6/1926 Boehm ..... D06F 95/006 383/71
4,783,978 A * 11/1988 Vallerga ..... A45C 1/00 150/123
D333,565 S * 3/1993 Imbert ..... D3/217
(Continued)

*Primary Examiner* — Fenn C Mathew
*Assistant Examiner* — Cynthia Collado
(74) *Attorney, Agent, or Firm* — Merchant & Gould P.C.

(57) ABSTRACT

A container includes a pair of flaps, which can be brought close to one another, one of the flaps having a buttonhole; and a clasp designed to get through the buttonhole. The clasp includes an anchoring portion, which is fixed to the other one of the flaps; a wide portion, which is designed to prevent the clasp from moving apart from the buttonhole; and an intermediate connection portion, connected, through a pair of hinges, to the anchoring portion and to the wide portion, respectively. The wide portion and the anchoring portion are configured to rotate relative to the intermediate portion, so that the clasp is able to assume a plurality of operating conditions. The buttonhole is designed to interact with the clasp based on the operating condition assumed by the clasp, allowing the flaps or walls be brought close to one another or preventing them from moving apart.

9 Claims, 6 Drawing Sheets

(56) References Cited

U.S. PATENT DOCUMENTS

| | | | | |
|---|---|---|---|---|
| 6,257,472 | B1 * | 7/2001 | Freedman | A45F 3/04 150/108 |
| D571,102 | S * | 6/2008 | Gostt | D3/244 |
| 10,058,157 | B2 * | 8/2018 | Brazzel | A45C 13/08 |
| 2008/0135142 | A1 * | 6/2008 | Ellis | A45C 1/024 150/104 |

* cited by examiner

CONTAINER, SUCH AS A BAG OR A LEATHER ARTICLE, COMPRISING A CLASP

This application is a National Stage Application of International Patent Application No. PCT/IB2015/058276, filed 27 Oct. 2015, which claims benefit of Serial No. TO2014A000880, filed 29 Oct. 2014 in Italy and which applications are incorporated herein by reference. To the extent appropriate, a claim of priority is made to each of the above disclosed applications.

TECHNICAL FIELD

The present invention relates to a container, such as a bag or a leather article, comprising a clasp.

TECHNOLOGICAL BACKGROUND

Different types of containers, such as bags or leather articles, are known, which are provided with clasps designed to cause two flaps or walls belonging to a container, such as a bag or a leather article, to be kept close to one another or to overlap.

For example, there are bags provided with clasps that can be fixed to one of said flaps or walls and are designed to be introduced, with a portion of theirs, into a buttonhole provided on the other one of said flaps or walls, so as to allow the aforesaid flaps or walls to be closed, or anyway to get closer to one another.

A bag provided with a clasp of the type described above is disclosed, for example, in patent EP 0 821 894.

However, bags provided with clasps known from the prior art are affected by different drawbacks.

SUMMARY OF THE INVENTION

An object of the present invention is to provide a container, such as a bag or a leather article, which is provided with a clasp, is able to solve the drawbacks of the prior art and, at the same time, can be manufactured in a simple and economic fashion.

In particular, one of the technical problems solved by the present invention is that of providing a container, such as a bag or a leather article, which is provided with a clasp that is reliable, easy to be used and not too large.

According to the present invention, this and other problems are solved by means of a container, such as a bag or a leather article, comprising a clasp.

The technical teachings are provided in the following detailed description concerning the present invention. In particular, some preferred embodiments of the present invention and descriptions of optional technical features.

Further features and advantages of the present invention will be best understood upon perusal of the following detailed description, which is provided by way of example and is not limiting, with reference, in particular, to the accompanying drawings, which are briefly described below.

DETAILED DESCRIPTION OF THE INVENTION

Figure 1:
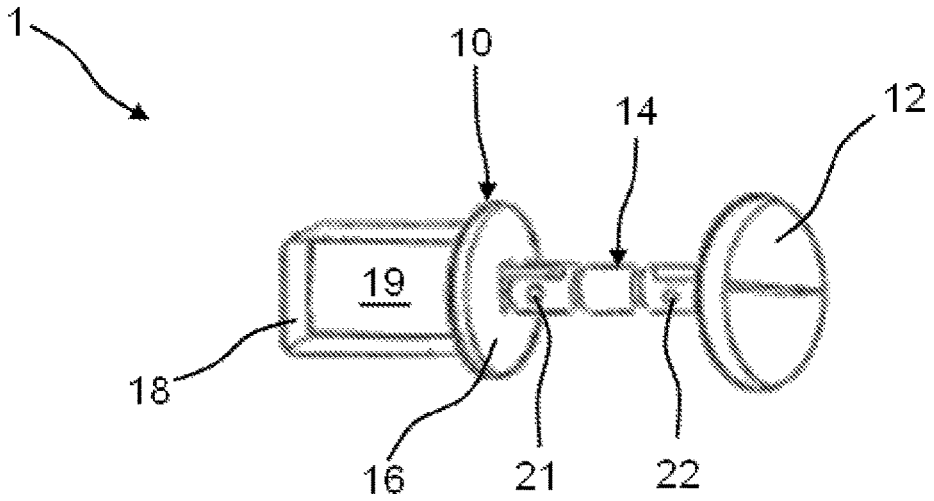
FIG. 1 is a perspective view of a clasp designed to be used in a container, such as a bag or a leather article, according to an embodiment of the present invention.

With reference, in particular, to FIGS. 1, 2*a*-*c*, number 1 indicates, as a whole, a clasp (or closing device) for a container, such as a bag or a leather article, manufactured according to an exemplifying embodiment of the present invention.

In the embodiment shown, the container is a bag or a leather article. However, this aspect should not be considered as limiting for the scope of protection assigned to the present invention, since the principle of the present invention can be also applied to other items capable of containing objects or articles.

Clasp 1 comprises an anchoring portion 10, for being fixed to a flap or a wall of the container. Furthermore, clasp 1 comprises a wide portion, such as, by mere way of example, a plaque 12, for preventing clasp 1 from moving apart from a buttonhole provided on another flap or wall of the container. Furthermore, clasp 1 comprises an intermediate connection portion, such as, by mere way of example, a rod 14, which is connected in a rotary manner, respectively to anchoring portion 10 through a first hinge 21 and, respectively, to plaque 12 through a second hinge 12.

Figure 2A:
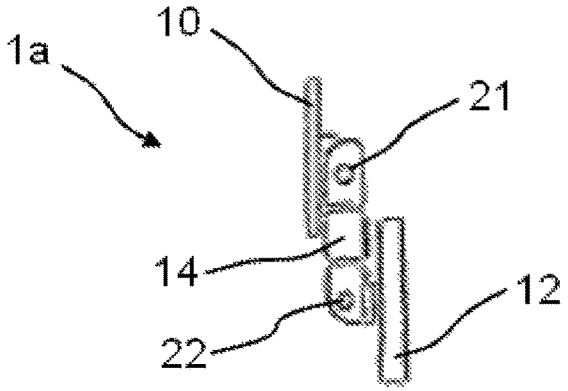
FIGS. 2*a*-2*c* are side views showing a sequence of operating conditions that can be assumed by the clasp shown in FIG. 1.
Figure 2B:
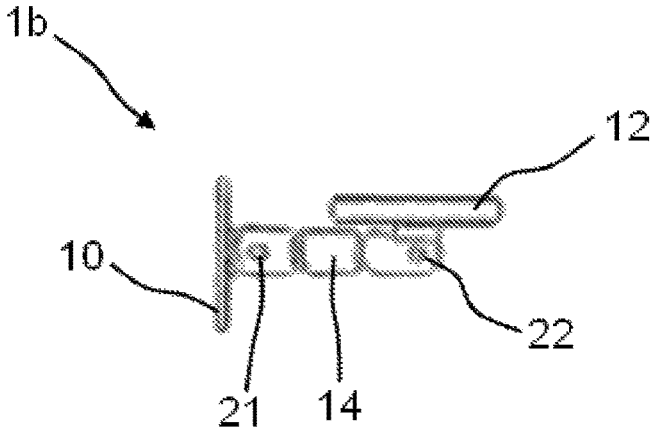
Figure 2C:
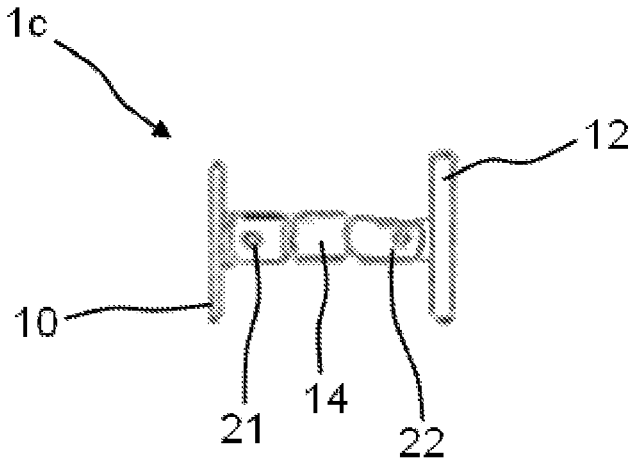

As you can see in FIGS. 2*a*-2*c*, anchoring portion 10 and plaque 12 are configured to be rotated, by a user, relative to rod 14, thus moving clasp 1 among a plurality of different operating conditions.

In particular, clasp 1 can assume:

- a compact condition (FIG. 2*a*), in which plaque 12 and anchoring portion 10 are close to one another and are juxtaposed on opposite sides relative to rod 14;
- an extended condition (FIG. 2*b*), in which plaque 12 is substantially aligned relative to rod 14, thus allowing clasp 1 to move towards the buttonhole;
- a closing condition (FIG. 2*c*), in which anchoring portion 10 and plaque 12 are arranged at a distance form one another, namely plaque 12 is arranged in a direction that is substantially transverse to rod 14, thus preventing clasp 1 from moving out of the buttonhole.

Therefore, plaque 12 conveniently is a plate-shaped or mainly two-dimensional element.

At least one of said hinges 21, 22 is a flat hinge that creates a hinge constraint in which the connected parts can rotate around the hinging axis.

Preferably, hinges 21, 22 are both flat hinges.

With reference to the preferred embodiment shown in FIG. 1, the hinging axes of said flat hinges 21, 22 are parallel to one another. Alternatively, the hinging axes of said flat hinges 21, 22 can also not be parallel to one another, for example they can be skew.

According to a further embodiment of the invention (not shown), at least one of the hinges is a spherical hinge. The term "spherical hinge" indicates a hinge constraint in which the connected parts are able to rotate in the space around a point in a three-dimensional manner.

In the embodiment shown in FIG. 1, anchoring portion 10 comprises a mainly two-dimensional plate 16. In particular, plate 16 has a cross section that is substantially similar to the one of plaque 12.

Preferably, as you can see only in FIG. 1 for simplicity reasons, plate 16 is associated with a plurality of sheets 18, which are connected to one another so as to form a polygonal structure. Plate 10 and sheets 18 form an opening 19, which is useful to constrain device 1 to the clothing accessory.

In the embodiment shown, the first hinge 21 is arranged at an axial end of rod 14.

In the embodiment shown, the second hinge 22 is arranged at an(-other) axial end of rod 14.

Preferably, the first hinge 21 is arranged in a middle or central portion of the anchoring portion, for example of plate 16. In particular, in the closing condition, plate 16 transversely extends on opposite sides relative to rod 14.

Preferably, hinge 22 is arranged in a middle or central portion of the wide portion, for example of plaque 12. In particular, in the closing condition, plaque 12 transversely extends on opposite sides relative to rod 14.

With reference to FIGS. 2*a-c*, hereinafter you will find a description of the operation of clasp 1.

In FIG. 2*a*, clasp 1 is in the compact or rest condition, in which plate 12 is at a minimum distance from anchoring portion 10. Plaque 12 and plate 16 are parallel to one another and are also parallel to rod 14. This arrangement allows the device to be compact, when it is not engaged with the buttonhole provided on a flap or wall of the bag.

As you can see in the drawings, the intermediate connection portion is preferably a rod 14 or, anyway, it develops longitudinally, in particular in a straight fashion.

By rotating rod 14 relative to anchoring portion 10 (in the example by 90°), clasp 1 reaches the extended or insertion condition, shown in FIG. 2*b*, in which plaque 12 and connection element 14 are parallel to one another. In this position clasp 1 can easily be introduced into/removed from the buttonhole provided on the bag.

After plaque 12—and part of rod 14—have been inserted through the buttonhole, the user rotates plaque 12 relative to rod 14 (in the example by 90°), thus causing the device to reach the closing position shown in FIG. 2*c*. In this position, plaque 12 is rotated relative to rod 14 (in the example they are substantially perpendicular), so as to prevent clasp 1 from moving apart from the buttonhole provided on the bag.

Preferably, at least one flat hinge 21 and/or 22 has a cam profile, for keeping a predefined mutual angular position between rod 14 and at least one between anchoring portion 10 and plaque 12, respectively. The cam is configured so as to provide a greater resistance to rotation around hinge 21, 22 when the elements connected by said hinge are in a predefined mutual angular position, so that these elements can be kept in the predefined position more firmly. Furthermore, the cam can also be made so as to offer a greater resistance in different mutual angular positions of the connected elements.

If the cam profile is obtained on the first hinge 21, the connected elements are rod 14 and anchoring portion 10. On the other hand, if the cam profile is obtained on the second hinge 22, the connected elements are rod 14 and plaque 12.

Conveniently, both hinges 21, 22 have a cam profile. Preferably, the cam profiles of hinges 21, 22 are manufactured so as to more firmly keep clasp 1 in the three operating conditions shown in FIGS. 2*a-c*.

Figure 3:
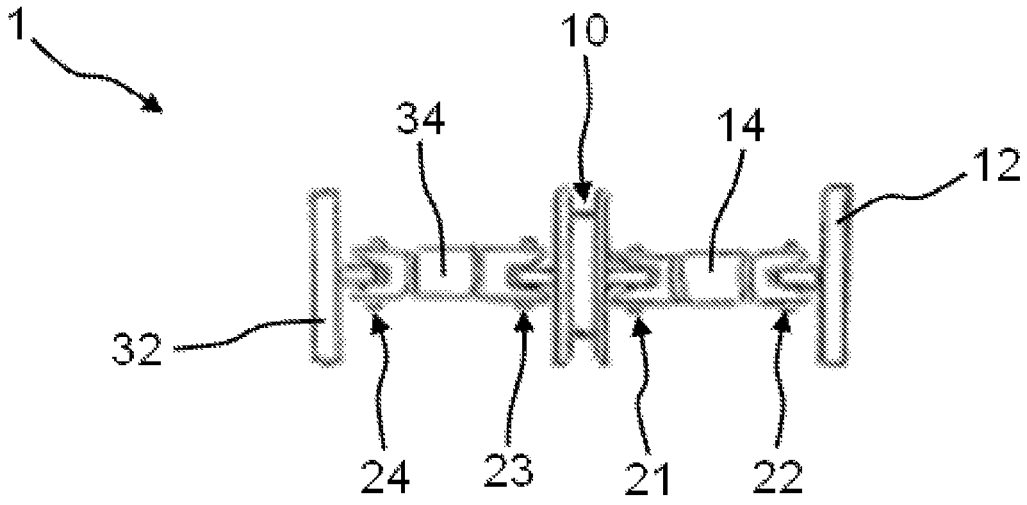
FIG. 3 is a perspective view of a variant of a clasp designed to be used in a container, such as a bag or a leather article, according to a further embodiment of the present invention.

FIG. 3 shows a further variant of clasp 1, wherein the same numerical references correspond to elements and components that are similar to the ones described in relation to the embodiment shown in the previous figures; for these elements and components reference is made to the description above.

In this embodiment, clasp 1 comprises a further wide portion, such as, by mere way of example, a further plaque 32, which is arranged on the opposite side relative to the wide portion described above. Therefore, the further plaque 32 is designed to prevent the device from moving apart from another buttonhole provided on the container. Furthermore, clasp 1 comprises a further intermediate connection portion, such as, by mere way of example, a further rod 34, hinged to anchoring portion 10 through a third hinge 23 and, respectively, to anchoring portion 10 through a fourth hinge 24.

Anchoring portion 10, the second plaque 32 and the second rod 34 can move to the same operating conditions (but on the opposite side) described above for the anchoring portion 10, plaque 12 and rod 14.

Preferably, through not necessarily, the elements arranged on the opposite sides of anchoring portion 10 have the same features as well as the same shape; in the way, therefore, the device is substantially symmetrical relative to the anchoring portion 10.

Preferably, hinges 23 and 24 are flat. More preferably, all the hinges 21, 22, 23, 24 are flat hinges. With particular reference, in particular, to FIG. 3, all the rotation axes of flat hinges 21, 22, 23, 24 are mutually parallel.

Therefore, this second variant of clasp 1 turns out to be useful, in particular, when there is the need to move three adjacent flaps of walls of the bag close to one another. More in detail, when anchoring portion 10 is fixed to the central flap or wall, each one of plaques 12 and 32 can cross a respective buttonhole obtained on the flaps or walls arranged on opposite sides relative to central flap or wall. In this way, sole clasp 1 can ensure a double closing on two opposite sides, thus bringing pairs of flaps or walls closer.

Figure 4:
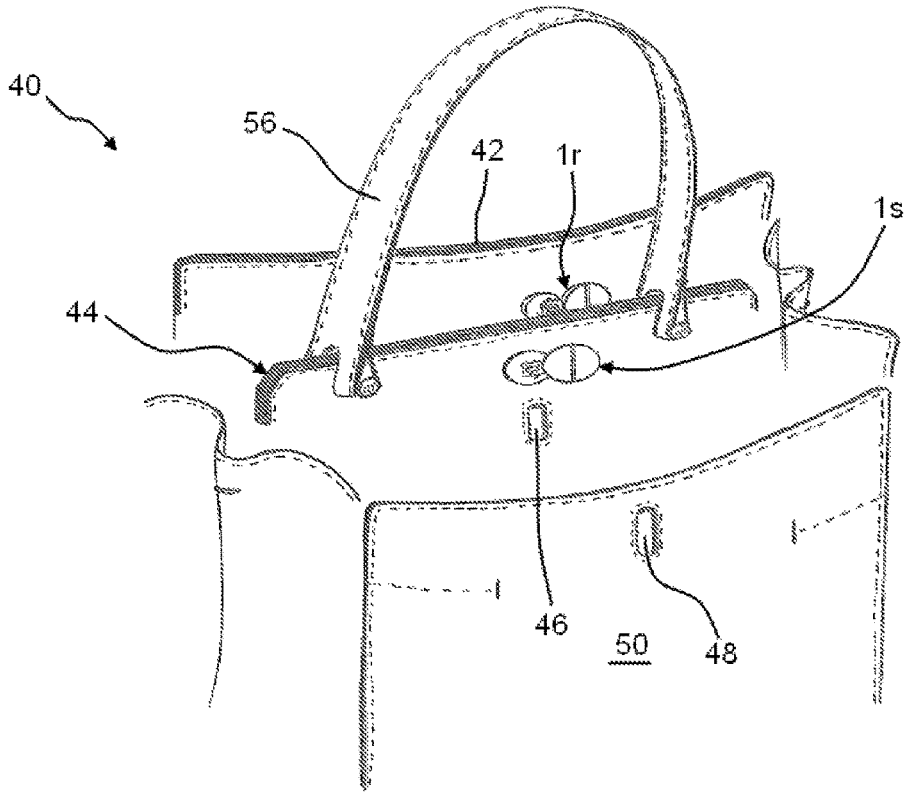
FIG. 4 is a perspective view of a container, such as a bag, which is made according to an embodiment of the present invention and comprises a pair of clasps shown in FIGS. 1, 2*a*-2*c*.

FIG. 4 shows an embodiment of a container, such as a bag 40. As we will explain more in detail below, bag 40 comprises a pair of clasps manufactured according to FIGS. 1 and 2*a-c*.

In this embodiment, bag 40 has a rear flap or wall 42, a central flap or wall 44 (also called "partition"), and a front flap or wall 50. In particular, rear flap or wall 42 and front flap or wall 50 are joined at the bottom by a bottom of the bag and on the sides by a pair of side walls (these details are not numbered in the drawings). Furthermore, there is also provided a handle 56, which, in the embodiment shown, is fixed to central flap or wall 44.

Preferably, central flap or wall 44 divides the inside of bag 40 into two compartments, which are separate from one another and delimited, on one side, by rear flap or wall 42 and, on the other side, by front flap or wall 50.

In particular, bag 40 is provided with one clasp 1*r*, which is associated with rear flap or wall 42 of bag 40, and a further clasp 1*s*, which, in turn, is associated with central flap or wall 44 (also called separator or "partition"). Clasp 1*r* is suited to engage the first buttonhole 46 provided on central flap or wall 44; whereas clasp is, on the other hand, is suited to engage a second buttonhole 48 obtained on front wall or flap 50.

In other words, with particular reference to the example shown, bag 40 comprises:

a pair of end flaps or walls (42, 50);

an intermediate flap (44);

a first clasp (1*r*), wherein said anchoring portion (10) is fixed to an end flap or wall (42) and said wide portion (12) faces said intermediate flap (44) so as to move through a hole (46) provided on said intermediate flap (44); and a second clasp (1*s*), wherein said anchoring portion (10) is fixed to said intermediate flap (44) and said wide portion (12) faces the other end flap or wall (50) so as to move through a hole (48) provided on the other end flap or wall (50).

Figure 5A:
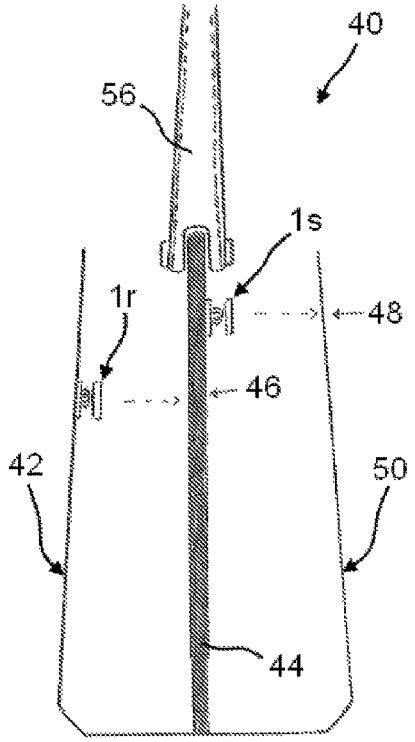
FIGS. 5*a*, 5*b*, 5*c* are schematic views, in a side section, of the bag shown in FIG. 4, wherein you can see a sequence of operating conditions that can be assumed by the clasp and the bag.

FIG. 5*a* shows a side section of bag 40 shown in FIG. 4. In this figure, clasps 1*r* and 1*s* are in the respective compact or rest condition. Therefore, the two compartments defined on the side of central flap or wall 44 are open and can accessed by a user, who, as a consequence, can introduce objects into bag 40 or pull them out of it.

Figure 5B:
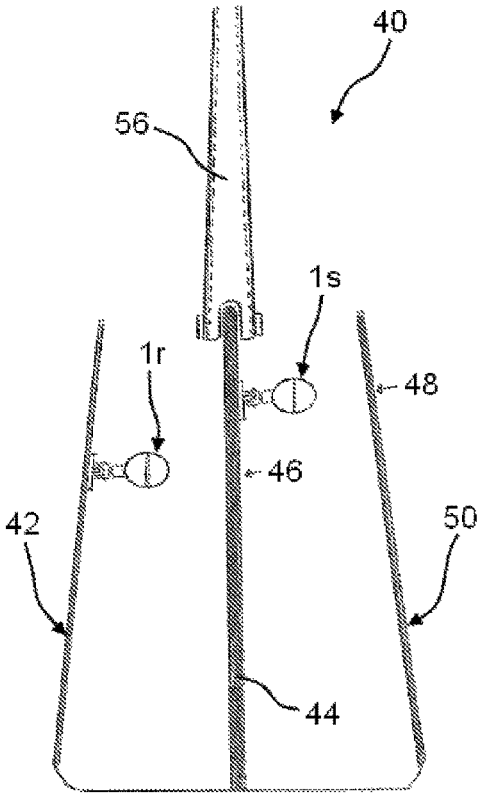

FIG. 5*b* shows a side section of bag 40 shown in FIG. 4. In this figure, clasps 1*r* and 1*s* are in the extended or insertion condition and, therefore, they are ready to be inserted into the respective buttonholes 46, 48.

Figure 5C:
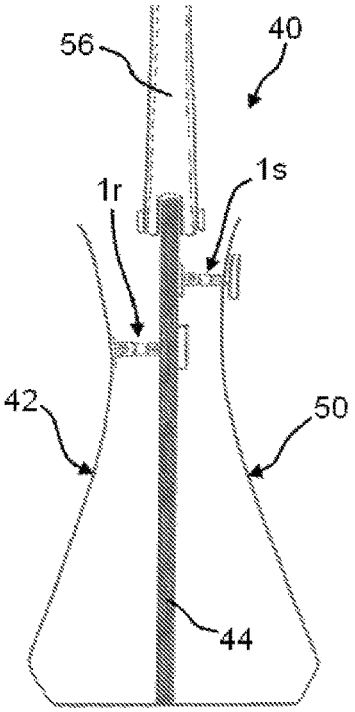

FIG. 5*c* shows a side section of bag 40 shown in FIG. 4, wherein clasps 1*r* and 1*s* are in the closing condition, after respective plaques 12 and rods 14 have been inserted into the respective buttonholes 46, 48. Therefore, the compartments of the bag have been pulled closer and kept closed, or juxtaposed, by means of said clasps 1*r*, 1*s*.

Figure 6:
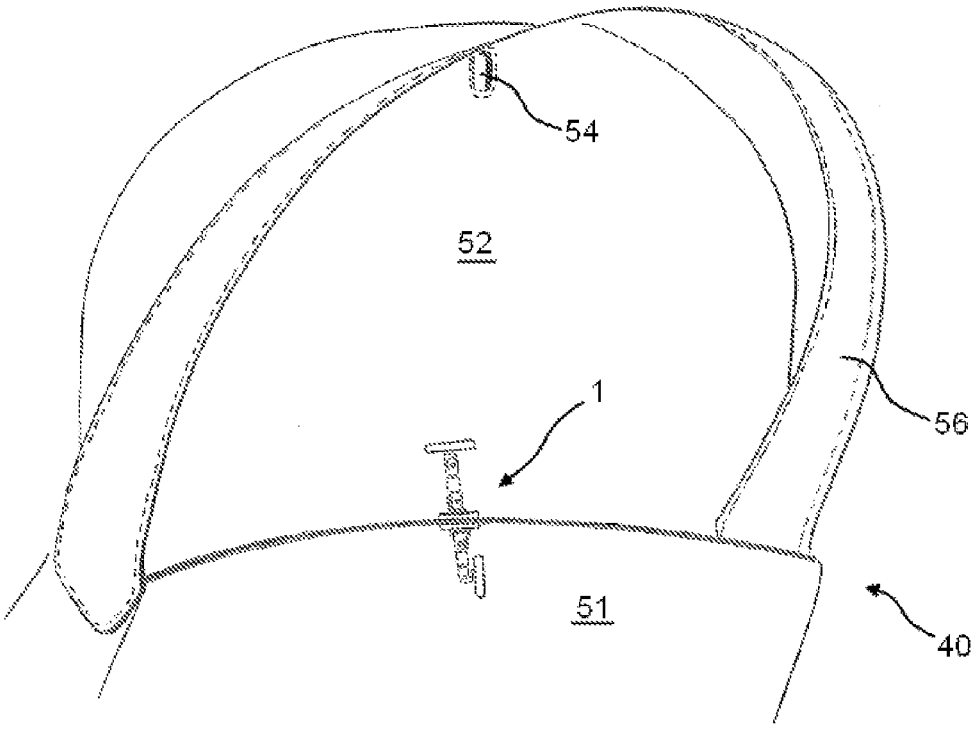
FIG. 6 is a partial perspective view of a bag made according to a further embodiment, wherein said bag comprising a clasp of the type shown in FIG. 3.
Figure 7:
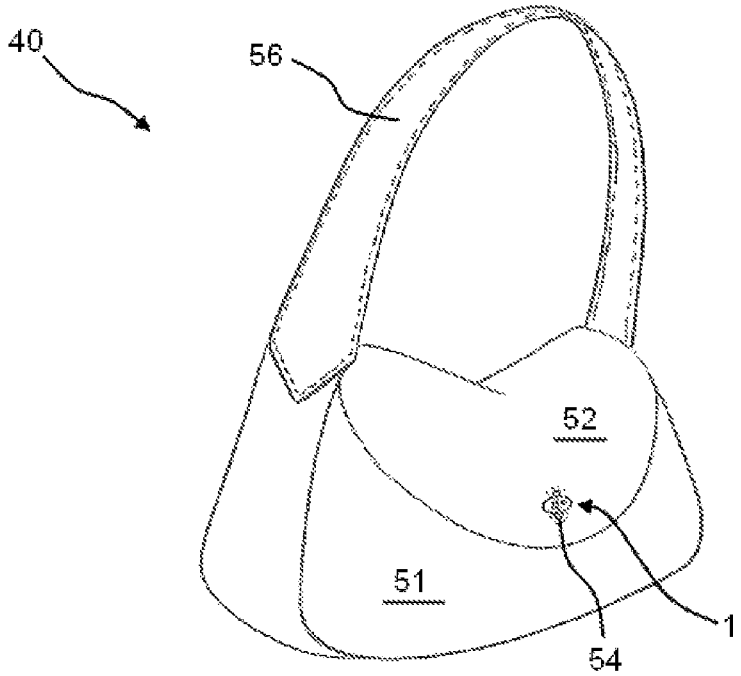
FIG. 7 is a partial perspective view of the bag shown in FIG. 6, herein represented in another operating condition.

FIGS. 6 and 7 show a further embodiment of a bag 40 comprising a clasp 1 designed like the one shown in FIG. 3.

In this embodiment, though, the structure of bag 40 comprises a front flap or wall 51 and a rear flap or wall (not numbered), which ends with a wing 52, which can be folded over front flap or wall 51 (FIG. 6) or can be lifted from the latter (FIG. 7).

In this embodiment, the handle is fixed to the side walls of bag 40 (details not numbered).

Clasp 1 is associated with the front flap or wall 51, so that plaque 12 and rod 14 face the outside of bag 40 and plaque 32 and rod 34 face the rear flap or wall carrying wing 52. More in detail, plaque 12 and rod 14 are suited to engage a buttonhole 54 provided on wing 52, when the latter is folded over front flap or wall 51. On the other hand, plaque 34 and rod 34 are suited to engage a buttonhole (not numbered) arranged on a portion of the flap or wall located in a proximal position relative to wing 52.

This embodiment is used to manufacture a "double face" or reversible bag. As a matter of fact, if the user turns bag 40 inside out, plaque 32 and rod 34 will be suited to be inserted, this time, into buttonhole 54.

As a person skilled in the art can clearly understand, for the use of "double face" bags, the clasp shown in FIG. 3 can also be applied to bags without wing 52; for example even bags that have a central flap or wall that, when necessary, can be removed from the bag (in this case, the anchoring portion is fixed on a central flap or wall and the buttonholes are provided on the other flaps or walls) or bags that only have a front flap or wall and a rear flap or wall (in this case, one of the two flaps or walls carries the anchoring portion, whereas the other flap or wall carries one single buttonhole, which is suited to be crossed from one side to the other by the clasp, depending on how the bag is turned).

Figure 8:
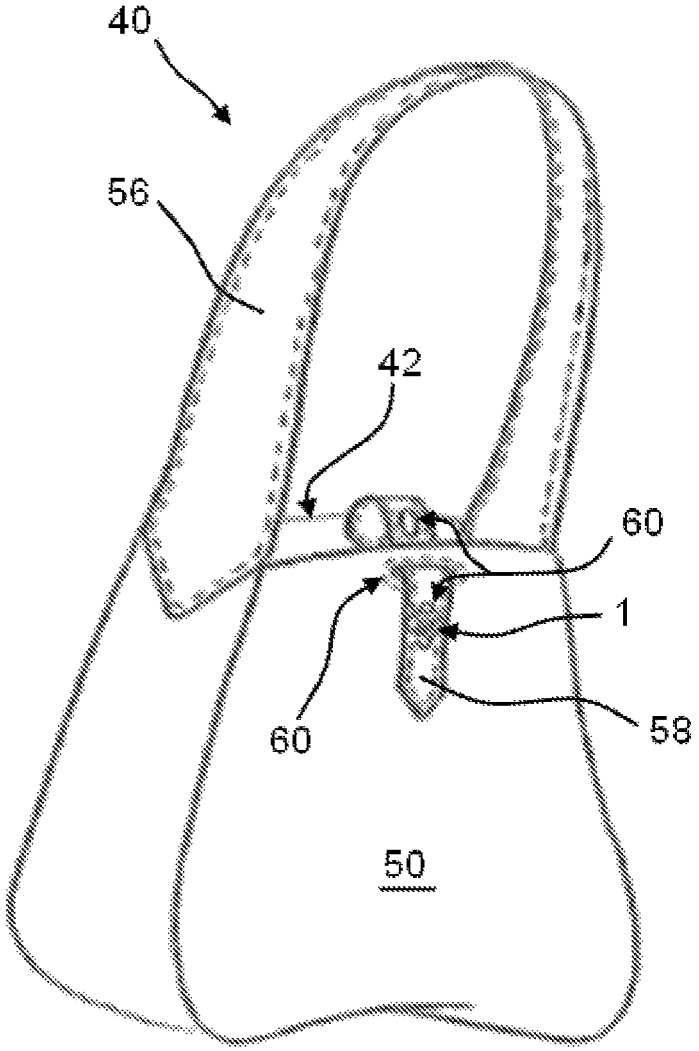
FIG. 8 is a perspective view of a bag according to another embodiment of the present invention.

FIG. 8 shows a further embodiment of a bag 40 comprising a clasp 1 designed according to FIGS. 1 and 2*a-c*.

In this embodiment, bag 40 comprises a rear flap or wall 42, which carries a belt 58 having one or more buttonholes 60, which are suited be engaged by clasp 1. In particular, clasp 1 is fixed on a front flap or wall 50 of bag 40 and projects with rod 14 and plaque 12 towards the outside of bag 40. Belt 58 conveniently is sewn on the outer or inner surface of rear flap or wall 42. Optionally, belt 58 can go through an opening 66 located in the front flap or wall, before being able to be engaged by clasp 1.

Naturally, the principle of the present invention being set forth, embodiments and implementation details can be widely changed relative to what described above and shown in the drawings as a mere way of non-limiting example, without in this way going beyond the scope of protection provided by the accompanying claims.

The invention claimed is:

1. A container, comprising:

a pair of flaps or walls, which can be brought close to one another, one of said flaps or walls having a buttonhole; and a clasp, which is designed to get through said buttonhole, the clasp, comprises:

an anchoring portion, which is fixed to the other one of said flaps or walls of said container, a wide portion, for preventing the clasp from moving apart from said buttonhole, and an intermediate connection portion, connected in a rotary manner, through a pair of hinges, to said anchoring portion and to said wide portion, respectively;

said wide portion and said anchoring portion are configured to rotate relative to said intermediate portion, so that said clasp is able to assume:

a compact condition, in which said wide portion and said anchoring portion are close to one another and are juxtaposed on opposite sides relative to said intermediate connection portion, an extended condition, in which said wide portion is substantially aligned relative to said intermediate connection portion, and a closing condition, in which said wide portion and said anchoring portion are arranged at a distance form one another, said wide portion being arranged in a direction that is substantially transverse to said intermediate connection portion;

said buttonhole being designed to allow said clasp to move through said buttonhole, allowing said flaps or walls to be brought close to one another, when said clasp is in said extended condition;

said buttonhole being designed to hold said clasp, preventing said flaps or walls from moving apart from one another, when said clasp is in said closing condition.

2. The container according to claim 1 comprising a plurality of said clasps, each one of said plurality of clasps keeping a respective pair of flaps or walls close to one another, when said clasp is in the closing position.

3. The container according to claim 1 comprising:

a pair of end flaps or walls;

an intermediate flap;

a first clasp, wherein said anchoring portion is fixed to an end flap or wall and said wide portion faces said intermediate flap to move through a buttonhole provided on said intermediate flap; and a second clasp, wherein said anchoring portion is fixed to said intermediate flap and said wide portion faces the other end flap or wall to move through a buttonhole (48) provided on the other end flap or wall.

4. The container according to claim 1, wherein at least one of said hinges is a flat hinge.

5. The container according to claim 4, wherein said hinges are both flat hinges.

6. The container according to claim 5, wherein hinging axes of said flat hinges are parallel to one another.

7. The container according to claim 4, wherein said flat hinge has a cam profile for maintaining a predetermined mutual angular position between said intermediate connection portion and at least one between said anchoring portion and said wide portion.

8. The container according to claim 1, wherein said clasp further comprises:

a further wide portion, arranged on an opposite side relative to said wide portion and for preventing the clasp from moving apart from a further buttonhole provided on said container; and a further intermediate connection portion, which is hinged, through a pair of further hinges, to said anchoring portion and to said further wide portion, respectively.

9. The container according to claim 8, wherein said further hinges are flat.

* * * * *